United States Patent [19]

Orro et al.

[11] 3,930,394

[45] Jan. 6, 1976

[54] MILL FOR PLUGGING TUBES AND TAKING THEM OFF PLUG

[76] Inventors: Pavel Ivanovich Orro, ulitsa Kirova, 8, kv. 25; Nikolai Grigorievich Kovalevsky, Oktyabrskaya ploschad, 5, kv. 6; Alexandr Ivanovich Lobanov, ulitsa Komsomolskaya, 10, kv. 18; Andrei Mikhailovich Arkhangelsky, Vysokovoltnaya ulitsa, 28, kv. 16; Valentin Anatolievich Makarov, ulitsa Poligonnaya, 22, kv. 32; Jury Georgievich Goreslavets, ulitsa Dnepropetrovskaya, 3, kv. 89, all of Dnepropetrovsk; Nikolai Konstantinovich Erokhov, ulitsa Bogomoltsa, 10, Nikopol; Georgy Iosifovich Khaustov, ulitsa Mironova, 23, kv. 11, Nikopol; Ivan Mikhailovich Obukh-Shvets, ulitsa Shevchenko 209, kv. 11, Nikopol; Alexandr Davydovich Vereschagin, ulitsa Baikalskaya, 11, kv. 103, Dnepropetrovsk, all of U.S.S.R.

[22] Filed: July 22, 1974

[21] Appl. No.: 490,865

Related U.S. Application Data

[63] Continuation of Ser. No. 359,888, May 14, 1973, abandoned.

[52] U.S. Cl. ..... 72/209; 72/283; 72/422

[51] Int. Cl.[2] ..... B21B 17/10

[58] Field of Search ..... 72/283, 287, 290, 209, 72/422, 426

[56] References Cited

UNITED STATES PATENTS

| | | | |
|---|---|---|---|
| 1,100,696 | 6/1914 | Offutt | 72/209 |
| 1,778,181 | 10/1930 | Brinkman | 72/283 |
| 2,074,271 | 3/1937 | Peters | 72/209 |
| 2,428,474 | 10/1947 | Snively | 72/283 |
| 2,560,058 | 7/1951 | Wrightson et al. | 72/422 |
| 2,597,500 | 5/1952 | Kerr | 72/283 |
| 3,392,565 | 7/1968 | Rodder | 72/209 |
| 3,590,622 | 7/1971 | Elge et al. | 72/209 |
| 3,593,553 | 7/1971 | Rodder | 72/209 |
| 3,712,104 | 1/1973 | Goeke | 72/422 |
| 3,733,871 | 5/1973 | Nagai | 72/209 |

*Primary Examiner*—Michael J. Keenan
*Attorney, Agent, or Firm*—Holman & Stern

[57] ABSTRACT

A mill is disclosed, said mill comprising a plug head for plugging tubes, one pulling device adapted to draw a tube with a plug through the plug head, a gear for taking tubes off the plug mounted in the rear portion of the pulling device and composed of power cylinders secured on the pulling device at an acute angle to a plane passing through guides of the pulling device with the rods of the power cylinders carrying jaws for gripping the tube being plugged, the jaws being attached to the rods, and two pockets wherein the tubes and plugs are placed after the tubes have been taken off the plugs. The invention is intended for providing a mill featuring an improved production rate with the ensuing augmentation of the production of a drawing mill, and having smaller overall dimensions.

3 Claims, 12 Drawing Figures

MILL FOR PLUGGING TUBES AND TAKING THEM OFF PLUG

This is a continuation of application Ser. No. 359,888, filed May 14, 1973, now abandoned.

BACKGROUND OF THE INVENTION

The present invention relates generally to tube drawing and more particularly, it relates to plug rolling mills for drawing seamless tubes and taking them off a plug after drawing over the long movable plug.

As compared with other types of tube drawing operations, tube drawing on long movable plugs has an important advantage, namely, the possibility of attaining considerable tube reduction per pass and drawing tubes (with wall reduction) of small diameters (down to capillary ones).

A main disadvantage of this method of drawing tubes on a long movable plug, restricting its application, is a need for labor-consuming additional technological operations, such as: plugging the drawn tube over the plug for withdrawing the latter out of the tube and the plug extraction process as such.

Mills for plugging tubes and taking them off a long movable plug after drawing are known in the art, comprising a plug head adapted to plug the tubes over the plug with the aid of idle tube-reducing members, a pulling device with guides for moving pulling elements therealong, the elements drawing the tube with the plug through the plug head, a gear for taking the tubes off the plug, two pockets wherein the tubes and plugs are placed after the tubes have been taken off the plugs and a drive for the pulling device.

The known designs of the mills aimed at further improvement of the long-lug drawing process as regards tube plugging and taking them off the plugs comprise, as a rule, apart from a drawing line, two additional working lines parallel with one another, namely, a tube plugging line and another line for taking the tubes off the plug.

Mills comprising two pulling devices arranged in line are also applicable, with one of the pulling devices being adapted in this case for pulling the tube together with the plug through a plug arrangement and the other one for extracting the plug from the tube. The time needed for returning the plug (after the tube has been taken off) to the drawing mill is an important factor governing the production rate of the plugging and drawing mills. When using two additional working lines or a single working line with two pulling devices, the flow sheets related to plugging and taking the tubes off the plug envisage periodical stoppage of the mills, reversal of the tube travelling with the plug or turning the plug with the tube through 180°.

The above additional operations diminish materially the production of both the plugging and drawing mills.

On the known mills for extracting the plugs from the tubes use is made of thrust plates with a calibrated opening, forks or clamps of the pulling devices gripping the tube fore part on one side and the plug end on the other.

The above operations involved in the extraction of the plugs from the tubes are responsible for the appearance of various defects on the tubes (scratches, galling, corrugation) and for the sticking of tube metal to the plugs.

The arrangement of equipment for plugging and taking the tubes off the plugs when using two additional lines or a single additional working line with two pulling devices requires considerable floor area. For further general details of a typical — plug rolling mill — see: The Making, Shaping and Treating of Steel, Chapter XXIX, Manufacturing of Steel - Tubular Products, pp. 1150–1152; a complete revision based on the original text by J. M. Camp and C. B. Francis, Sixth Ed., 2nd Impression, published by United States Steel Company, Copyright 1951 by U.S. Steel Company.

SUMMARY OF THE INVENTION

The main object of the invention is to provide a mill for plugging tubes and taking them off a plug, which will enable plugging and taking the tubes off the plug to be performed with the help of one pulling device and one additional working line.

Another object of the invention is to provide a mill which will allow plugging tubes and taking them off a plug at a single working pass with the tube and plug moving in the same direction.

Still another object of the invention is to provide a mill featuring smaller overall dimensions.

Yet another object of the invention is to provide a mill featuring an enhanced production rate with the ensuing increase in the yield of a drawing mill.

A further object of the invention is to provide a mill which will make it possible to enhance the quality of tubes and to reduce reject figures.

These and other objects of the invention are accomplished in a mill for plugging tubes and taking them off a long movable plug after their drawing, comprising a plug head for plugging tubes on a plug with idle tube-reducing members, a pulling device with guides for moving pulling elements therealong to draw the tube with the plug through the plug head, apparatus for taking the tubes off the plug, two pockets wherein the tubes and plugs are placed after taking the tubes off the plugs, and a drive for the pulling device.

According to the invention, the apparatus for taking the tubes off the plug is mounted on the pulling device in its rear portion adjacent to the plug head and is composed of power cylinders secured on the pulling device at an acute angle to a plane passing through the guides of the pulling device, with cylinder rods mounting jaws for gripping the tube.

In order to prevent the arisal of impact loads when gripping the tube, jaw misalignment relative to the plug axis and to ensure the return of the jaws to their initial position in case of an emergency pressure drop in the power cylinders for the jaws, it is expedient that the apparatus for taking the tubes off the plug be provided with additional cylinders parallel with the above-specified power cylinders in one and the same plane and provided with spring-biased rods connected to the jaws.

To prevent accidental damaging of the tube surface when being gripped by the jaws of the apparatus for taking the tube off the plug, it is also expedient that the jaws be provided with resilient elements coming into direct contact with the surface of the tube being gripped.

The essence of the present invention is thus the provision of a mill for plugging tubes and taking them off a plug allowing: plugging the tube and taking it off the plug at a single pass in one working line (without reversing the plug and the tube) with the aid of one pulling device; enhancing the production rate of the mill for plugging tubes and taking them off the plug with the ensuing increase in the production rate of a drawing mill; taking the tube off the plug with the help of a pneumatic appliance which precludes the possibility of damaging the tube surface; and more rapid return of the plug for re-use (after the tube has been taken off) to the drawing mill.

BRIEF DESCRIPTION OF THE DRAWINGS

The present invention will be better understood from a consideration of a detailed description of an exemplary embodiment thereof, to be had in conjunction with the accompanying drawings, wherein.

DETAILED DESCRIPTION OF THE PREFERRED EMBODIMENT

Figure 1:
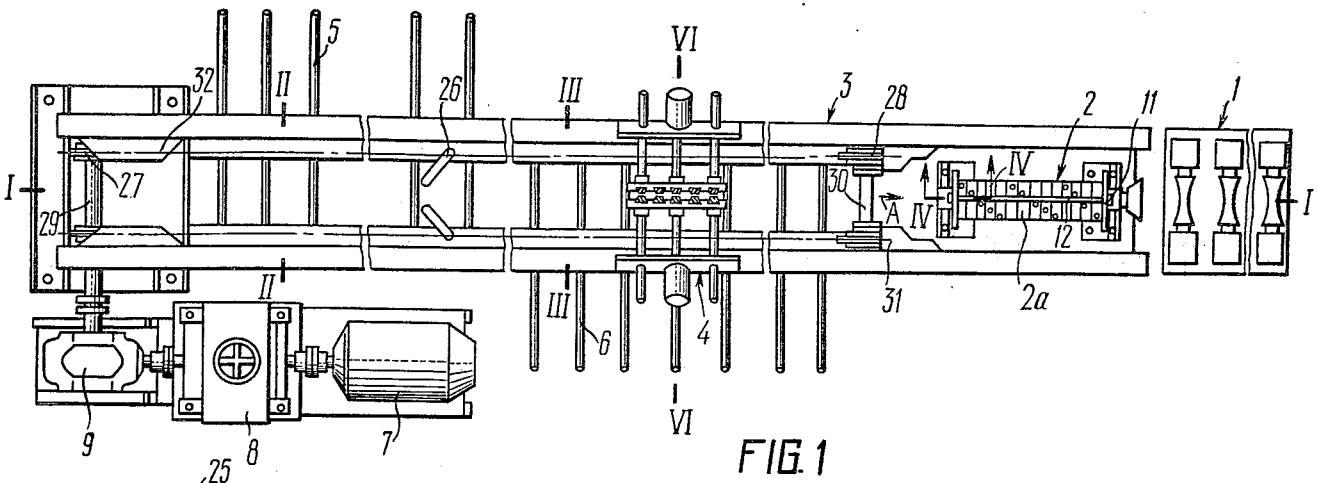
FIG. 1 shows a diagrammatic plan general view of the mill for plugging tubes and means for taking them off a plug, according to the invention.
Figure 2:
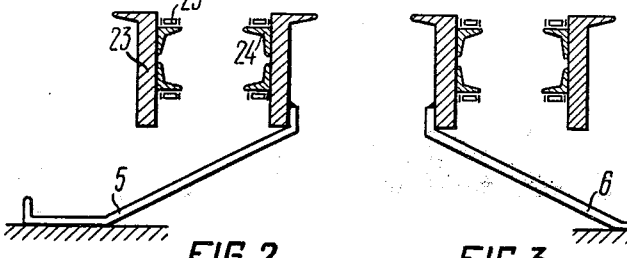
FIG. 2 is a section view taken along the line II—II of FIG. 1.
Figure 3:
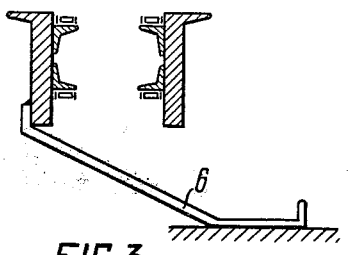
FIG. 3 is a section view taken along the line III—III of FIG. 1.

Referring to FIGS. 1 through 12, a mill for plugging tubes and taking them off a plug comprises the following main units (FIG. 1): a conveyor table 1 onto which a tube with a plug is delivered from a drawing mill, the plug being arranged after the roll table, as viewed in the direction of movement of the tube being plugged, a plug head 2 wherein the tube is delivered from the roll table 1 is plugged, a pulling device 3 adapted to draw the tube with the plug through the plug head 2, apparatus 4 for taking the tube off the plug, the apparatus being set up on the rear portion of the pulling device 3 adjacent to the plug head 2, lateral pockets 5 and 6 for respectively receiving the plugs and tubes after being separated, and a pulling device drive which consists of an electric motor 7, a speed variator 8 (for changing the plugging rate) and a reducer 9.

The roll table 1 comprises a plurality of transverse rollers having a concave surface and forming a trough; see FIG. 1.

Figure 5:
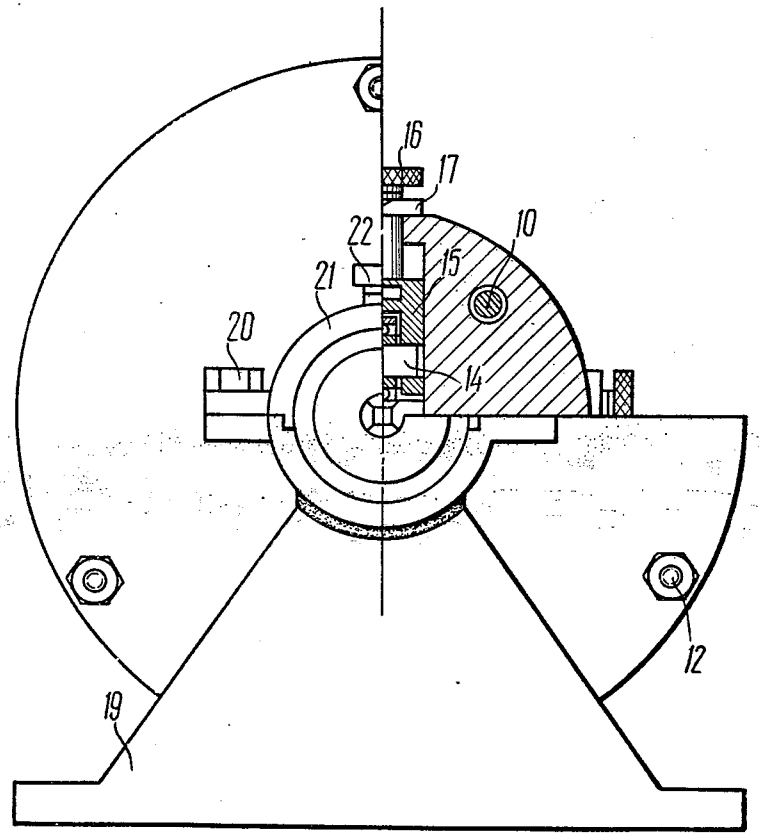
FIG. 5 is an enlarged view of the plug head along an arrow A of FIG. 1 with a fragmentary cutaway.
Figure 4:
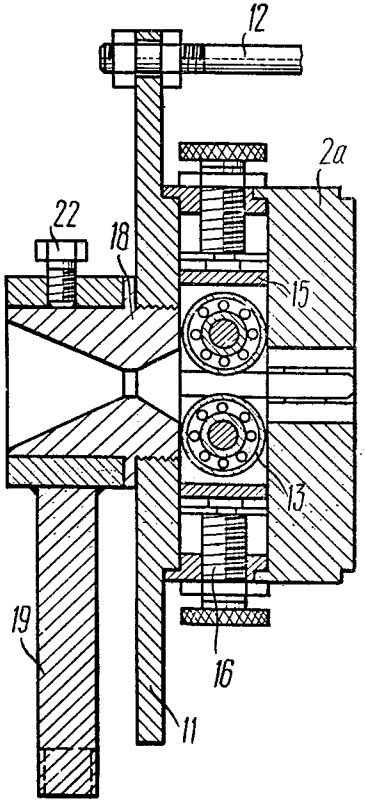
FIG. 4 is an enlarged section view taken along the line IV—IV of FIG. 1.
Figure 6:
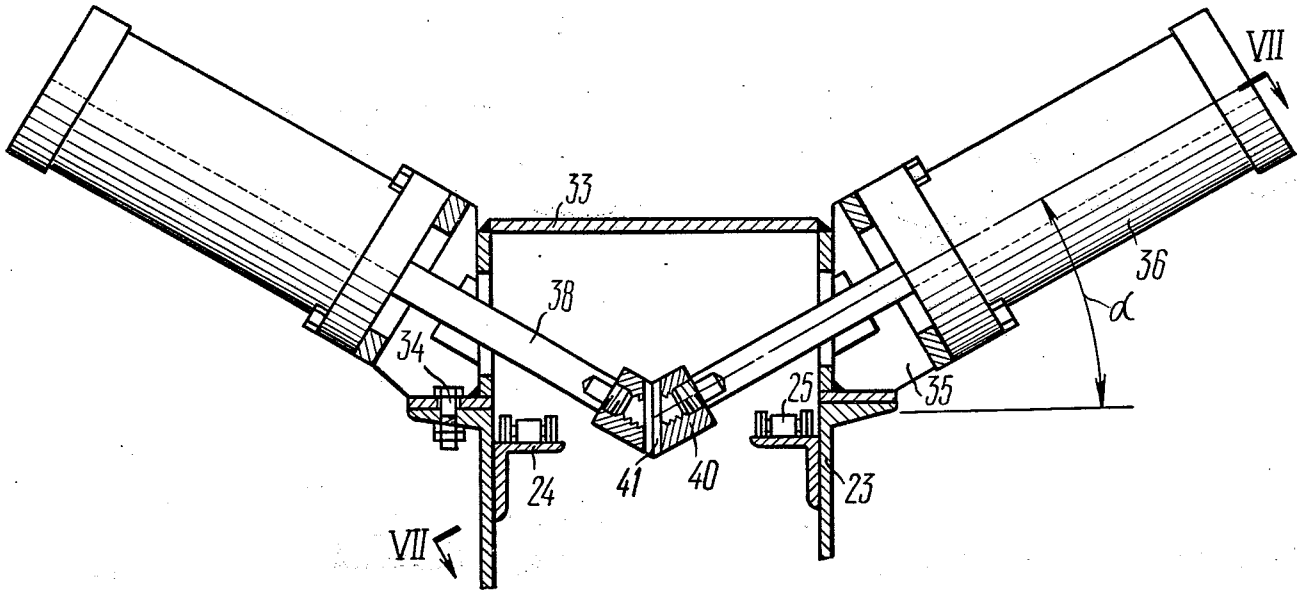
FIG. 6 is an enlarged section view taken along the line VI—VI of FIG. 1.
Figure 7:
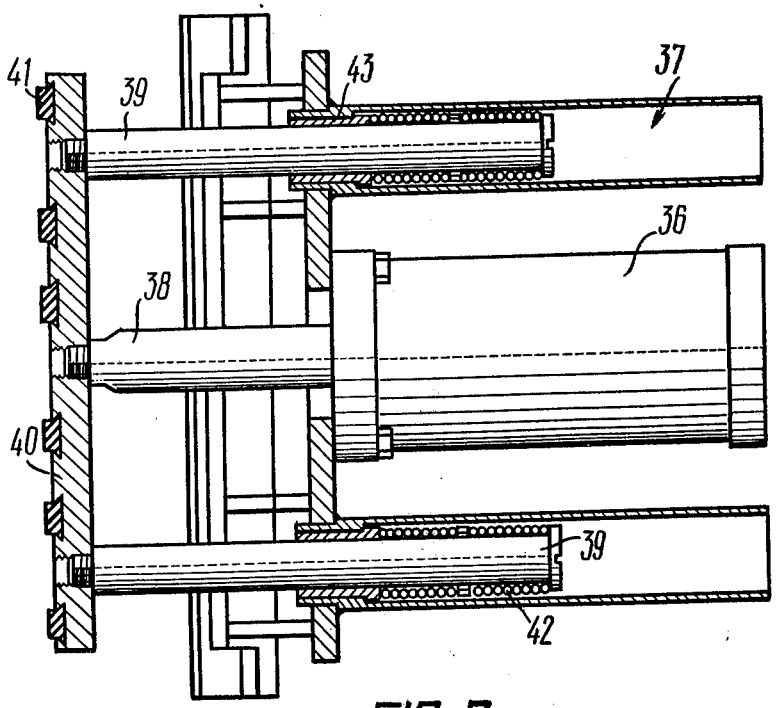
FIG. 7 is a section view taken along the line VII—VII of FIG. 6.
Figure 8:
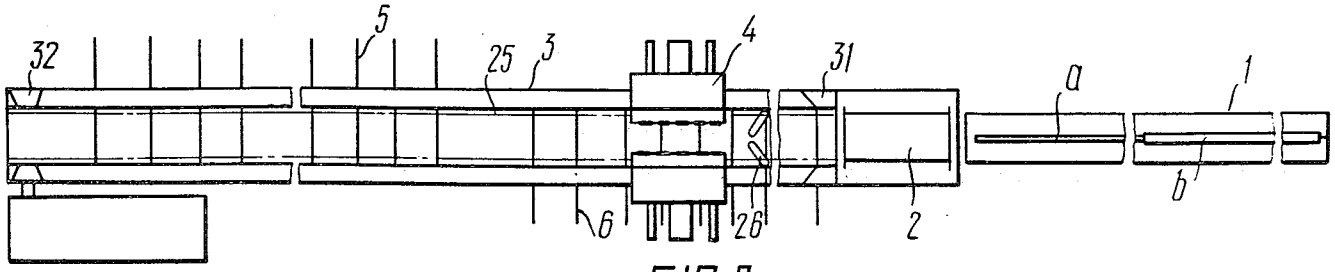
FIG. 8 is a diagrammatic layout of the plug with the tube on the roll table prior to plugging.
Figure 9:
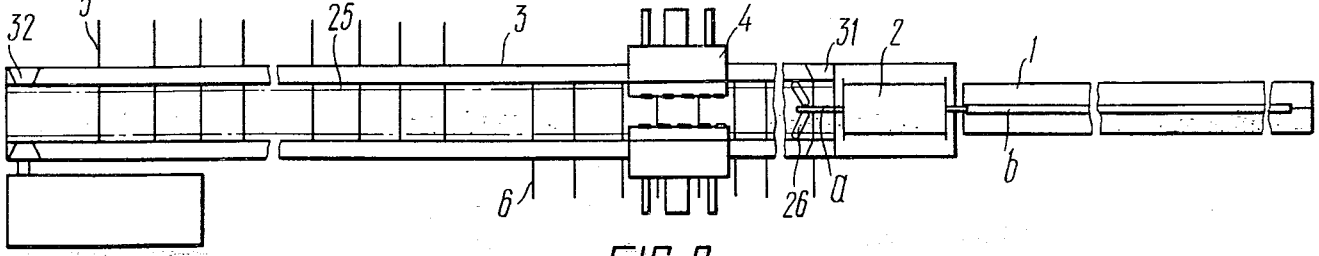
FIG. 9 is a schematic diagram showing the gripping of the plug end by the clamps of the pulling device.
Figure 10:
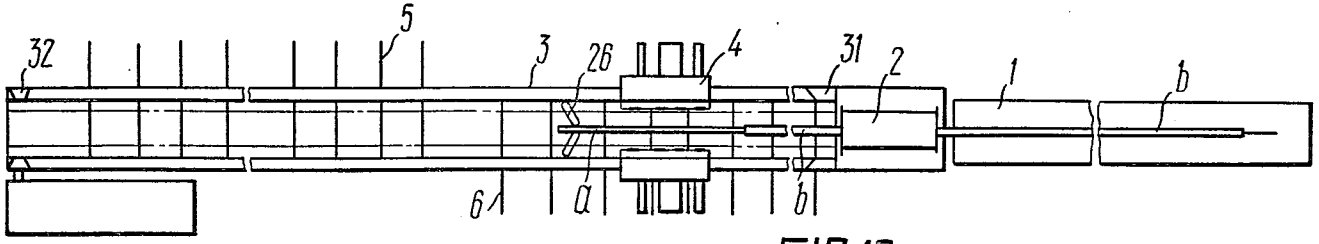
FIG. 10 is a schematic diagram illustrating the drawing of the plug with the tube through the plug head during plugging.
Figure 11:
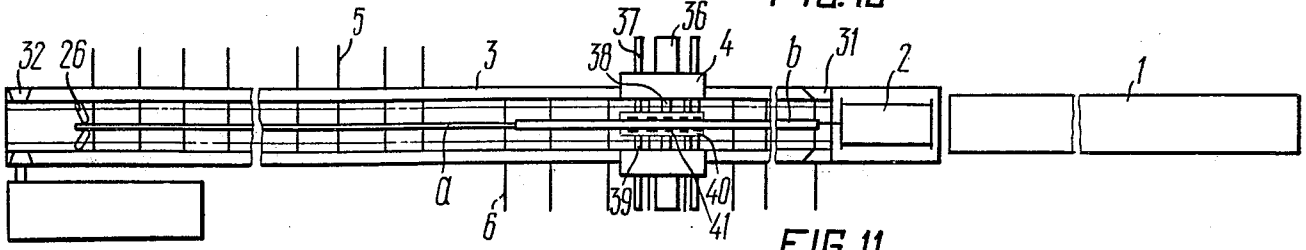
FIG. 11 is a schematic diagram showing taking the tube off the plug.

The plug head 2 arranged between the pulling device 3 and roll table 1 consists of fourteen stands 2*a*. The latter are joined together in pairs at an angle of 90° to each other by pins 10 (FIG. 5). This precludes the possibility of bending the rod with the plug in the course of plugging. Each pair of the stands is turned through an angle of 50° relative to the neighbouring pair. The above arrangement of the stands ensures regular plugging (reducing) of the tube along its circumference to provide an annular clearance between the tube and plug sufficient for free extraction of the plug from the tube. As a result of this regular plugging, wall thickness variation as a practical matter does not increase during the process.

The stands 2*a* are connected to each other by flanges 11 and pins 12; (see FIGS. 1, 4 and 5).

As to the plugging members (reducing the tube over the plug) of the plug head 2, use is made of ball bearings 13 (two bearings per stand).

The use of the ball bearings as reducing members is convenient (there being no need for producing special rollers or rolls), ensures adequate rigidity when plugging the tubes, high quality of the tube surface and a minimum effort when drawing the tube with the plug through the plug head 2.

The ball bearings 13 are anchored on shafts 14 secured in chocks 15. The chocks 15 in which the ball bearings 13 are secured are exposed to the effect of housing screws 16 which ensure individual adjustment of reduction of the tube wall over the plug in each stand.

To exclude spontaneous rotation of the housing screws 16, use is made of lock nuts 17.

In order to enable more convenient rotation of the housing screws 16 when adjusting the degree of reduction of the tubes being processed, the plug head 2 is able to rotate about its longitudinal axis in trunnions 18 secured in supports 19.

To prevent spontaneous rotation of the plug head 2 during the plugging operation, covers 21 with a stop screw 22 are attached to the supports 19 by bolts 20. On being screwed in, the stop screw 22 rests against the trunnion 18 of the head 2.

The pulling device 3 drawing the tube with the plug through the plug head comprises two frames 23 (FIGS. 2 and 6) arranged parallel to each other, fastened on the inside with guides 24, in which guides travel two endless pulling (conveyor) chains 25 of the pulling device 3. Articulated internally to the chains 25 are clamps 26 (FIG. 1) gripping the plug end.

The chains 25 are brought into rotation by a pair of drive sprocket wheels 27 located at the front end of the pulling device and at the rear end of the pulling device 3, the chains 25 are entrained on a pair of driven sprocket wheels 28; shaft 29 and 30 of the drive and driven sprocket wheels respectively are parallel with each other.

At the rear end of the pulling device 3 are mounted guards 31 (elements adapted to bring the clamps apart) opening the clamps 26 for gripping the plug end with the tube before drawing thereof.

To bring the clamps 26 apart after plugging, taking the tube off the plug and releasing the plug, guards 32 (elements for releasing the clamps) are arranged at the front end of the pulling device 3.

For placing the tubes and plugs separately after they have been disconnected, provision is made for pockets 5 and 6 fastened under the pulling device 3 in its front and rear portions to frames 23 of the pulling device and located on the opposite sides of the device.

The pocket 5 designed for accommodating the plugs is located on the side of the pulling device facing the drawing mill. The pocket 6 intended for the tubes is located on the external side of the mill. The pockets 5 and 6 are built up of a plurality of rubberized metallic rods or pipes arranged in parallel.

The apparatus 4 for taking the tube off the plug is mounted on the rear (upstream) portion of the pulling (conveying) device. A primary function of the gear 4 when taking the tube off the plug is to fix the tube when the plug is being extracted from it by travelling clamps 26 of the pulling device 3.

The gear for taking the tubes off the plug comprises a welded casing 33 (FIG. 6) secured with the aid of bolted connections 34 to both frames 23 of the pulling device 3.

Welded on both sides of the casing 33 are brackets 35, each of them mounting one power (air) cylinder 36 and two auxiliary cylinders 37 (FIG. 7) with each power cylinder 36 being arranged between the two auxiliary cylinders 37.

The power and auxiliary cylinders set up on both sides of the casing 33 of the gear 4 are located in planes passing through a plugging axis I-I and inclined to a plane passing through the guides 24 of the pulling device at an angle $\alpha$ sufficient for these cylinders not to interfere with the guides arranged in the plane and with the pulling chains 25 travelling in the guides 24.

Jaws 40 with resilient elements 41 are connected to rods 38 and 39 of the power and auxiliary cylinders. The resilient elements 41 are mounted in dovetail slots provided in the jaws.

When the jaws 40 come together and the tube is gripped, the resilient elements 41 come into contact directly with the tube surface precluding thereby its damage.

The auxiliary cylinders 37 are adapted to reduce impact loads on the tube when it is gripped, to prevent misalignment of the jaws 40 with respect to the plugging axis I—I and to impart the jaws 40 a backward motion to bring them apart in case of an emergency pressure drop in the power cylinders 36.

For reducing the impact loads on the tube when it is gripped and for bringing the jaws 40 apart in case of an emergency drop in pressure in the power cylinders 36, the auxiliary cylinders 37 are provided with springs 42 which are compressed during a forward stroke (when the jaws are brought together) and actuate the rods 39 of the auxiliary cylinders.

The operation of a mill for plugging tubes and taking them off a plug is performed in the following manner.

A plug *a* with a tube *b* is delivered from a drawing mill to the roll table 1 (FIG. 8) moving strictly axially, without rotation with the rear end of the plug *a* facing a plug head 2. In this case the length of the end of the plug *a* protruding freely from the tube *b* must exceed the total length of the plug head 2 and guards 31 arranged on the read end of a pulling device 3.

With the chains 25 of the pulling (conveying) device 3 in motion, clamps 26, on passing through the guards 31 and contacting them are brought apart to receive the end of the plug *a* projecting from the plug head 2.

Upon passing the guards 31, the clamps 26 under the effect of springs (not shown in the drawing) grip (FIG. 9) the end of the plug *a* drawing (FIG. 10) the plug *a* with the tube *b* through the plug head 2.

Bearings 13 (reducing members) of the plug head 2 reduce uniformly the wall of the tube *b* along its circumference.

As a result, an annular clearance is formed between the tube *b* and the plug *a.*

On completion of the process of plugging the tube *b,* compressed air is fed into the power cylinders 36 of the gear 4 for taking the tubes off the plug, rods 38 and 39 of the power cylinders 36 and auxiliary cylinders 37 perform a forward stroke, the jaws 40 are brought together (FIG. 11) and hold the plugged tube *b* with their resilient elements 41 in place preventing it from moving further.

The clamps 26 of the pulling device 3 which continue their travel extract the plug *a* from the thus fixed tube *b.*

After the plug *a* has been completely extracted from the tube *b,* the rods 38 and 39 of the apparatus 4 for taking the tube off the plug perform a (reverse) stroke.

Figure 12:
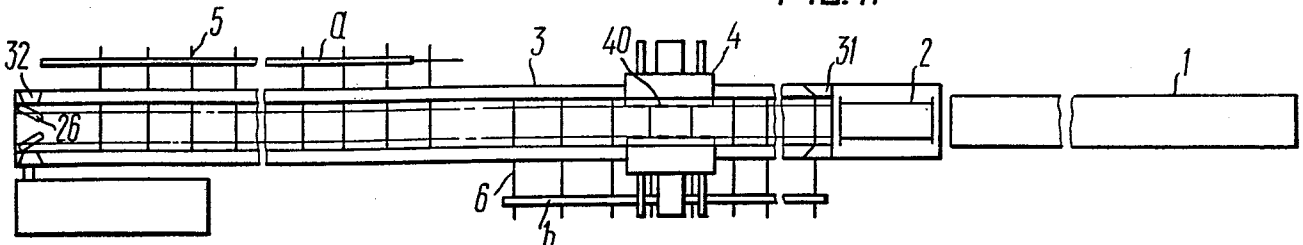
FIG. 12 is a layout of the plugs and tubes in the pockets.

The jaws 40 with the resilient elements 41 are brought apart and the tube *b* falls into a pocket 6 (FIG. 12).

During this period, the clamps 26 pulling the plug *a* extracted from the tube *b* contact guards 32 located at the front end of the pulling device 3 being thereby brought apart, whereupon the plug *a* falls into a pocket 5 located on the pulling device 3 on the side of the drawing mill.

What we claim is:

1. A mill for plugging tubes and taking them off a plug after drawing, said mill comprising: a roll table onto which a tube with a plug is delivered from a drawing mill; a plug head for plugging the tubes placed over the plug to provide a clearance between the tube and plug for extracting the plug from the tube, the plug head being formed as a plurality of stands disposed one after another, in which stands bearings are utilized as plugging members, the plug head being installed downstream of said roll table, as viewed in the direction of movement of the tube being plugged, and wherein the tube is delivered from said roll table; a conveying device being disposed downstream of said plug head as viewed in the direction of movement of the tube being plugged, said pulling device comprising two frames arranged parallel to each other and fitted with guides along which two endless conveying chains are transferred by a pair of drive sprocket wheels, said chains carrying articulated clamps for gripping one end of the plug to draw the tube with the plug through said plug head and to extract the plug from the tube on completion of the plugging operation, said conveying device being provided with elements for moving said clamps apart before they have gripped the tube and when the tube is released from said clamps; and apparatus for separating the tubes from the plug set up on said pulling device in its rear portion adjacent to said plug head and comprising power cylinders secured on said pulling device at an acute angle to a plane passing through said guides of said pulling device so that the cylinders do not interfere with the guides located in said plane and with the pulling chains moving along the guides; said power cylinders having rods which carry jaws fastened to them and adapted for gripping and holding the tube being plugged in place to enable the extraction of the plug from the tube with the help of said clamps.

2. A mill of claim 1, wherein to prevent impact loads on the tube when gripped, misalignment of said jaws with respect to said plugging axis and to return said jaws to their initial position in case of emergency pressure drop in said power cylinders, a gear for taking the tubes off the plug is furnished with auxiliary cylinders located in parallel with said power cylinders in the same plane, said auxiliary cylinders having spring-biased rods connected to said jaws.

3. A mill of claim 1, wherein to prevent damage on the surface of the tube when gripped with said jaws of the gear for taking the tubes off the plug, said jaws are fitted with resilient elements which contact directly the surface of the tube being gripped.

* * * * *